US006416391B1

(12) United States Patent
Kononchuk et al.

(10) Patent No.: US 6,416,391 B1
(45) Date of Patent: Jul. 9, 2002

(54) METHOD OF DEMOUNTING SILICON WAFERS AFTER POLISHING

(75) Inventors: Oleg V. Kononchuk; Zbigniew J. Radzimski, both of Brush Prairie, WA (US)

(73) Assignee: SEH America, Inc., Vancouver, WA (US)

( * ) Notice: Subject to any disclaimer, the term of this patent is extended or adjusted under 35 U.S.C. 154(b) by 0 days.

(21) Appl. No.: 09/514,861

(22) Filed: Feb. 28, 2000

(51) Int. Cl.[7] ..... B24B 7/22

(52) U.S. Cl. ..... 451/41; 451/65; 134/902; 134/3

(58) Field of Search ..... 451/41, 65, 73; 134/198, 902, 3

(56) References Cited

U.S. PATENT DOCUMENTS

| | | | | | |
|---|---|---|---|---|---|
| 4,050,954 | A | * | 9/1977 | Basi | 134/2 |
| 4,466,852 | A | * | 8/1984 | Beltz et al. | 156/344 |
| 4,874,463 | A | | 10/1989 | Koze et al. | |
| 4,973,563 | A | | 11/1990 | Prigge et al. | |
| 5,219,613 | A | | 6/1993 | Fabry et al. | |
| 5,389,194 | A | | 2/1995 | Rostoker et al. | |
| 5,609,719 | A | | 3/1997 | Hempel | |
| 5,645,737 | A | * | 7/1997 | Robinson et al. | 216/99 |
| 5,656,097 | A | * | 8/1997 | Olesen et al. | 134/1 |
| 5,759,971 | A | * | 6/1998 | Manako | 134/3 |
| 5,779,520 | A | * | 7/1998 | Hayakawa | 451/41 |
| 5,789,360 | A | | 8/1998 | Jae-inh Song et al. | |
| 5,908,347 | A | | 6/1999 | Nakajima et al. | |
| 5,943,549 | A | | 8/1999 | Motoura et al. | |
| 6,147,002 | A | * | 11/2000 | Kneer | 438/692 |
| 6,187,684 | B1 | * | 2/2001 | Farber et al. | 438/704 |

OTHER PUBLICATIONS

Reddy et al., Defect States at Silicon Surface; PHYSICA B, pp. 468–472.

* cited by examiner

*Primary Examiner*—Robert A. Rose
(74) *Attorney, Agent, or Firm*—Douglas G. Anderson

(57) ABSTRACT

A process for demounting silicon wafers from a polishing plate is provided, wherein a polishing plate containing wafers is subjected to a fluid stream to separate the wafer from the polishing plate. The wafer then passes through a fluid stream to rinse the wafer. Finally, the wafer is placed in a cassette that is submerged in a dilute solution of hydroflouric acid and water, and waits in que for a standard cleaning process. By storing the wafer in the solution containing hydroflouric acid, metal precipitation on the surface of the wafer is prevented.

5 Claims, No Drawings

METHOD OF DEMOUNTING SILICON WAFERS AFTER POLISHING

FIELD OF THE INVENTION

The present invention generally relates to the field of manufacturing silicon wafers in the microelectronics industry. More particularly, it relates to a method of improving the surface quality of silicon wafers during the demounting step of a chemical-mechanical polishing process.

BACKGROUND OF THE INVENTION

One of the final steps in producing a silicon wafer for use in semiconductor devices is the Chemical-Mechanical (CM) polishing process. Conventionally, several different machines have been used in the polishing process: a mounting machine for mounting wafers to a polishing plate; a polishing machine for pushing the polishing plate against a polishing pad; and a demounting machine for removing the wafers from the polishing plate. Both the wafers and the polishing plates are then sent to be cleaned.

Recently, advances have been made in the CM polishing machines that have incorporated all of these machines into one, with the exception of cleaning the wafers. After the wafers are removed from the polishing plate, they are placed in a cassette which is submersed in pure water until the cassette is full, at which time it is transferred to a cleaning machine. An example of such an advancement is described in U.S. Pat. No. 5,908,347.

During the actual polishing process, a polishing slurry is supplied to the polishing machine and polishing pad to provide an abrasive. Typically, the polishing slurry contains colloidal silicon dioxide as the abrasive, but other substances such as metal oxides (such as $Al_2O_3$) can also be used. After the polishing process, the wafers are sprayed with de-ionized (DI) water to keep the wafers wet and prevent staining of the wafers. The wafers then need to be individually removed from the polishing plate. As such, the polishing plate, with the wafers adhered thereon, is transferred to a demount station. The station then inclines the polishing plate, and positions the first wafer to be demounted in a position such that a water jet at an oblique angle to the wafer can separate the wafer from the polishing plate. The wafer then passes through a quick DI water rinse, and is placed in a cassette that submerged in DI water in a demount holding tank. The demount station then positions the polishing plate to remove the next wafer.

As a wafer is removed from the polishing plate, the water jet moves the wafer through a water rinse to remove the residual slurry from the surface of the wafer. This rinse, however, is much like a waterfall, and the wafer passes through this water very quickly. It then moves to the demount holding tank.

As soon as the wafer gets into the demount holding tank, it immediately begins growing an oxide layer on the surface of the wafer using the reaction $$Si+2H_2O \rightarrow SiO_2+2H_2$$

However, copper ions in the DI water also begin to precipitate at exposed silicon sites as copper metal with the Reduction/Oxidation equations $$2Cu^{+2}+4e^- \rightarrow 2\ Cu$$

$$Si+2H_2O \rightarrow SiO_2^-+4H^++4e^-$$

$$2Cu^{+2}+Si+2H_2O \rightarrow SiO_2^-+2Cu+4H^+$$

with the oxide layer butting up against the copper precipitate. When the cassette in the demount holding tank is full, the cassette full of wafers is transferred to a cleanline that proceeds to clean the wafers surface. A typical cleaning process uses a combination of SC 1 (a mixture of ammonium hydroxide, hydrogen peroxide, and water) and/or SC2 (Hydrochloric acid, hydrogen peroxide and water) in water. One skilled in the art can readily find much literature regarding cleaning of wafers after polishing. During such a cleaning, the copper precipitate dissolves in the cleaning process, but where the copper precipitate was located, a small pit is etched into the surface of the wafer.

When the wafer is then inspected for particles the etch pits show up on the surface of the wafer as Light Point Defects (LPDs). LPDs, whether from etch pits or from particles, negatively impact the surface quality of the wafer during IC fabrication, and are therefore undesirable to have. Much effort and expense has been expended trying to improve water quality and remove as much contamination as possible, with reasonable results. Unfortunately, there is significant cost associated with continued improvement to water quality, both in preparation and in delivery of such water. As such, there is a need for a method of eliminating etch pits caused from copper precipitation on silicon wafers during the que time from polishing demount to cleaning that does not require significant improvements in water quality.

SUMMARY OF THE INVENTION

The present invention has been accomplished in view of the above-mentioned problems, and it is an object of the present invention to provide an environment for preventing copper to precipitate on the surface of polished wafers while in que to be cleaned using any standard post-polishing cleaning process.

DETAILED DESCRIPTION OF THE INVENTION

The present invention calls for adding a solution of hydroflouric (HF) acid in the water of the demount holding tank. The reduction/oxidation equations for a silicon wafer in an HF solution is $$2Cu^{+2}+4e^- \rightarrow 2Cu$$

$$Si+6F^- \rightarrow SiF_6^{-2}+4e^-$$

$$2Cu^{+2}+Si+6F^- \rightarrow SiF_6^-+2Cu$$

with no silicon dioxide growth whatsoever. This reduction/oxidation reaction occurs much slower than the previously described equation when no HF acid is present, and thereby significantly slows the copper precipitation process.

Further, the stronger the concentration of HF in solution, the slower the copper precipitation process occurs, up to the point of prohibiting growth of the precipitation. However, high concentrations of HF in solution will etch the surface of the wafer, thereby removing the polished surface just provided, making the surface relatively rough, and degrading the flatness of the wafer.

It has been found that putting a solution of between 0.5% and 10% by volume of) in pure filtered water will inhibit the precipitation of copper, without negatively effecting the surface roughness or flatness of the wafer. Most preferably, the concentration by volume is approximately 6%. By using such a low percent of HF, the wafers can also stay submerged in the solution for extended periods of time without experiencing undo etching, yet still providing adequate protection against metal precipitation on the surface of the wafer. The above-described mechanism specifically discusses precipitation of copper, but the process of the present invention will help prevent precipitation of other metal in found in water as well.

EXAMPLE OF A PREFERRED EMBODIMENT OF THE PRESENT INVENTION

Three sets of control group wafers were submitted to DI water contaminated with copper ions at 10 parts per trillion (ppt), 50 ppt, and 300 ppt respectively. Sample wafers from each control group were analyzed for LPDs in 10 minute increments, starting at immediate submersion in the DI water held in the demount holding tank, and ending at one hour. The wafers were then sent through a standards SC 1 cleaning process, and dried using infrared drying. The wafers were then analyzed for LPD at ≧0.12 microns. Results are outlined in Table 1.

TABLE 1

LPD (≧0.12 μm) COUNT WHERE WAFERS ARE HELD IN THE DEMOUNT STATION IN DI WATER ONLY

| Time in demount holding tank | 10 ppt $Cu^{+2}$ | 50 ppt $Cu^{+2}$ | 300 ppt $Cu^{+2}$ |
|---|---|---|---|
| 0 minutes | 50 | 75 | 100 |
| 10 minutes | 25 | 25 | 25 |
| 20 minutes | 25 | 50 | 3,000 |
| 30 minutes | 50 | 500 | 10,000 |
| 40 minutes | 100 | 3000 | |
| 50 minutes | 200 | 4000 | |
| 60 minutes | 300 | 5000 | |

Three more test groups were then ran, wherein the DI water was contaminated with copper ions at the levels of 0 parts per billion (ppb), 1 part per billion, and 5 parts per billion. The DI water was mixed with hydroflouric acid at 6% by volume, and wafers were again submitted to the water ranging from immediate immersion to 60 minutes soaking time, by 10 minute increments. Thereafter the wafers were removed and processed through the same SC 1 cleaning process as for the control group above, and then inspected for LPD at ≧0.12 microns. Results of this test are included in Table 2.

TABLE 2

LPD (≧0.12 μm) COUNT WHERE WAFERS ARE HELD IN 6% BY VOLUME HF IN DI WATER IN THE DEMOUNT STATION

| Time in Demount Holding Tank | 0 ppb $Cu^{+2}$ | 1 ppb $Cu^{+2}$ | 5 ppb $Cu^{+2}$ |
|---|---|---|---|
| 0 minutes | 50 | 75 | 250 |
| 10 minutes | 25 | 50 | 200 |
| 20 minutes | 10 | 25 | 50 |
| 30 minutes | 10 | 500 | 500 |
| 40 minutes | 25 | 800 | 1000 |
| 50 minutes | 100 | 1100 | 2500 |
| 60 minutes | 300 | 1200 | 4750 |

The results listed in Tables 1 and 2 are reasonably comparable in the amount of LPD detected. The advantage of the present invention, however. is that the contamination of copper ions present in water can be increased from a parts-per-trillion range up to parts-per-billion range while maintaining similar or slightly better levels of LPD, thereby easing the requirements of water cleanliness resulting in significant financial savings.

It should be noted that copper has been the main focus of this written description, but similar reduction/oxidation mechanisms take place for other metal ions. Other embodiments of the present invention will be apparent to those skilled in the art from a consideration of this specification or practice of the invention disclosed herein. It is intended that the specification and example be considered in all aspects only as illustrative and not restrictive. The scope of the invention is, therefore, indicated by the appended claims rather than by the foregoing description. All changes which come within the meaning and range of the equivalence of the claims are to be embraced within their scope.

What is claimed is:

1. A method of demounting silicon wafers after a polishing process, comprising the steps of:

(a) providing a polishing plate, said polishing plate containing at least one wafer adhered to a surface of said polishing plate;

(b) subjecting said polishing plate to a fluid stream at an oblique angle such that said fluid stream can separate said wafer from said polishing plate;

(c) passing said wafer through said fluid stream; and (d) preventing native oxide growth and metals precipitation on the surface of said wafer by placing said wafer in a cassette, said cassette being submerged in a solution of hydrofluoric acid and water.

2. The method of demounting silicon wafers after a polishing process as recited in claim 1, wherein said solution contains between 0.5% and 10% by volume of hydroflouric acid.

3. The method of demounting silicon wafers after a polishing process as recited in claim 1, wherein said fluid stream is a water stream.

4. The method of demounting silicon wafers after a polishing process as recited in claim 1, wherein said fluid stream is a solution of hydroflouric acid and water.

5. The method of demounting silicon wafers after a polishing process as recited in claim 4, wherein said solution contains between 0.5% and 10% by volume of hydroflouric acid.

* * * * *